United States Patent [19]

Cohen et al.

[11] 4,355,261

[45] Oct. 19, 1982

[54] DISCHARGE LAMP WITH INTEGRAL STARTER

[75] Inventors: Sheppard Cohen, Danvers; Nikolaos Barakitis, Haverhill, both of Mass.

[73] Assignee: GTE Products Corporation, Stamford, Conn.

[21] Appl. No.: 216,875

[22] Filed: Dec. 15, 1980

[51] Int. Cl.[3] ..... H01J 7/44

[52] U.S. Cl. ..... 315/47; 315/73; 315/290

[58] Field of Search ..... 315/290, 47, 46, 73; 337/22

[56] References Cited

U.S. PATENT DOCUMENTS 2,286,789 6/1942 Dench ..... 315/47

*Primary Examiner*—Harold A. Dixon

*Attorney, Agent, or Firm*—Edward J. Coleman

[57] ABSTRACT

A low wattage high intensity discharge lamp having a quartz arc tube and a glow starter disposed within a bulbous glass envelope containing an inert gas, such as argon, at subatmospheric pressure. The starter within the envelope comprises a first bimetal connected to one of the arc tube lead-in wires, a second bimetal connected to one end of a conductive support wire sealed through the bulbous envelope, and a fixed first contact attached to another conductive support wire sealed through the bulbous envelope and also connected to the other lead-in wire of the arc tube. The bimetals are electrically connected together at one end which makes a normally closed contact with the fixed contact in the quiescent state of the starter. Energization of the lamp causes short circuit current to flow through the starter to cause flexing of the second bimetal for separating the bimetals from the fixed contact to provide an open circuit thereat and produce a high voltage pulse switching transient across the arc tube electrodes. Upon starting of a discharge in the arc tube, the lamp current flow through the starter is operative to maintain the bimetals separated from the fixed contact. The amplitude of the pulse produced by the starter is controlled by the selection of the gas and pressure thereof within the bulbous envelope.

11 Claims, 3 Drawing Figures

DISCHARGE LAMP WITH INTEGRAL STARTER

BACKGROUND OF THE INVENTION

This invention relates to arc discharge lamps, and more particularly, to an improved low wattage, high intensity discharge lamp adapted for more efficient starting and operation.

Conventional ballast circuits for operating high intensity discharge lamps have been constructed from leakage reactance transformers and reactors and may or may not include a spike or pulse starter. Typically, the discharge current through the lamp is controlled by the inductive reactance of the transformer core at a 60 Hz line frequency. As will be discussed hereinafter, such ballasts are not particularly suitable for the much smaller size, lower wattage high pressure metal halide arc discharge lamps currently being introduced. For example, one such lamp is discussed in U.S. Pat. No. 4,161,672, which also describes the use of double-ended arc tubes for such lamps. Further, copending applications U.S. Ser. Nos. 132,933 and 132,934, both filed Mar. 24, 1980 and assigned to the present assignee, describe low wattage metal halide arc discharge lamps having a press-sealed single-ended arc tube, that is to say, an arc tube in which both electrodes are located in a press-seal at one end of the arc tube. Practical designs of such lamps have ranged from 100 watts to less than 10 watts. The approximate electrical characteristics of one such lamp, for example, are 50 volts, 1 ampere, 40 watts. In many applications of such discharge lamps, the art tube, which is typically formed of UV-transmitting quartz glass, is enclosed in a glass outer jacket, which provides protection and blocks UV. Further, the outer jacket is pumped to provide a vacuum therein for blocking heat loss from the ignited arc tube and, thus, assure efficient operation.

Considering the aforementioned characteristics of a low wattage lamp, one would ordinarily think that the most desirable ballast to use on 120 volt, 60 Hertz lines would be the simple reactor. The reactor has the advantages of low cost, low loss, small size and weight and good lamp operation. This type of ballast is applicable where line voltage is sufficient to start the lamp. If necessary, a starting device, such as a pulse starter, is often used to facilitate starting such as with high pressure sodium lamps.

Although a low wattage discharge lamp, such as that described in the aforementioned copending application Ser. No. 132,933, ignites under these conditions, great difficulty is exhibited in making the glow-to-arc discharge transition. An obvious way to improve the transition process is to increase the open circuit voltage; for example, increasing the voltage to approximately 240 volts by autotransformer action solves this problem. Such a solution, however, although technically satisfactory, increases the size, cost and especially the losses to a degree that the low wattage high intensity discharge lamp loses its attractiveness as a product.

A copending application U.S. Ser. No. 216,876, filed concurrently herewith and assigned to the present assignee, describes an efficient ballast and starting system that ignites a low wattage discharge lamp, facilitates the transition from glow-to-arc, and operates the lamp satisfactorily. In the specific circuit embodiment disclosed in that application, a lead circuit ballast and a glow-bottle starter device are coupled between a source of AC line voltage and the discharge lamp. More specifically, the glow-bottle starter device is of a unique type having three lead-in wire terminals sealed through an hermetically sealed envelope enclosing a pair of bimetal strips and a rigid conductor rod respectively connected to the three terminal wires. The bimetals are electrically connected together at one end which makes a normally closed contact with the rigid conductor rod in the quiescent state of the device. The ballast circuit comprises an inductive means, such as a reactor choke coil, and a capacitor series connected in that order between a first AC input terminal and one of the bimetal terminals of the starter device. Means are provided for connecting the second AC input terminal to the rigid conductor rod terminal of the starter device, and means are provided for connecting the conductor rod terminal and the other bimetal terminal of the starter device across the terminals of a discharge lamp. Upon initial energization of the circuit, short circuit current through one of the bimetals is operative to flex the bimetals for separating them from the rigid conductor rod to provide an open circuit thereat and a high voltage pulse switching transient across the lamp. Upon starting of the lamp, the lamp current flow through the two bimetals is operative to maintain the bimetal contact separated from the rigid conductor rod. The hermetically sealed envelope of the starter device contains a selected gas at a selected subatmospheric pressure for controlling the amplitude of the high voltage pulse produced by the starter.

SUMMARY OF THE INVENTION

It is an object of the present invention to provide an improved arc discharge lamp which facilitates a simplification and reduction of the cost of the aforementioned circuit including a discrete three-wire glow-bottle starter device.

A further object is to provide an arc discharge lamp adapted for improved starting and operation.

Yet another object of the invention is to provide an improved low wattage high intensity discharge lamp adapted for efficient ignition and reliable transition from glow-to-arc, with subsequent maintenance of satisfactory operation.

These and other objects, advantages and features, are attained, in accordance with the invention, by an arc discharge lamp comprising an hermetically sealed bulbous glass envelope having first and second external terminals and an hermetically sealed arc tube disposed within the bulbous envelope and enclosing a pair of spaced apart electrodes. The arc tube has a pair of lead-in wires respectively connected to the electrodes therein. A glow starter means is also disposed within the bulbous envelope and includes a switching means electrically connected across the lead-in wire of the arc tube. Preferably the glow starter is current-responsive and includes a normally-closed switching means. A first conductor means within the bulbous envelope electrically connects one side of the glow starter means to the first external terminal of the lamp, and a second conductor means within the lamp connects the other side of the starter means to the second external electrode of the lamp. The normally closed state of the starter switching means thereby provides a short circuit between the first and second external terminals of the lamp. Further, the bulbous envelope contains an inert gas at subatmospheric pressure which provides the atmosphere facilitating operation of the glow starter means.

The first and second external terminals of the bulbous envelope are connectable to a source of lamp operating current, and upon energization of the first and second external terminals, the glow starter means is responsive to the short circuit current therethrough to provide an open circuit at the switching means thereof and produce a high voltage pulse switching transient across the arc tube electrodes. Upon starting of a discharge in the arc tube, the glow starter means is responsive to the lamp current flow therethrough to maintain the open circuit state of the switching means thereof. The amplitude of the pulse produced by the starter means is controlled by the selection of the gas and pressure thereof within the bulbous envelope.

In a preferred embodiment, the integral glow starter means and respective connection thereof in association with the arc tube within the bulbous envelope are provided as follows. A first substantially rigid conductor means within the bulbous envelope electrically connects one of the arc tube electrodes to the first external terminal; a second conductor means within the bulbous envelope is electrically connected to the other of the arc tube electrodes; and, a third conductor means within the bulbous envelope is spaced apart from the second conductor means and electrically connected to the second external electrode of the lamp. A glow starter means is also disposed within the bulbous envelope and comprises a first bimetal connected at one end to the second conductor means, a second bimetal connected at one end to the third conductor means, and a fixed first contact means disposed on the first conductor means. The bimetals are electrically connected together at the other end which makes a normally closed contact with the fixed contact in the quiescent state of the starter means. Further, the bulbous envelope further contains an inert gas at subatmospheric pressure.

The first and second external terminals of the bulbous envelope are connectable to a source of lamp operating current, and upon initial energization of the first and second external terminals, short circuit current through the first and third conductor means connected to the starter means is operative to flex the second bimetal for separating the bimetals from the fixed contact means to provide an open circuit thereat and produce a high voltage pulse switching transient across the arc tube electrodes. Upon starting of a discharge in the arc tube, the lamp current flow through the second and third conductor means is operative to maintain the bimetals separated from the rigid member. The amplitude of the pulse produced by the starter means is controlled by the selection of the gas and pressure thereof within the bulbous envelope.

In a preferred embodiment, the lamp is a low wattage high intensity discharge lamp, and the arc tube is formed of quartz glass, with the bulbous envelope being formed of hard glass. The lamp is particularly intended for connection to a circuit comprising; first and second input terminals for connection to a source of AC line voltage; an inductive means and a capacitive means series connected in that order between the first AC input terminal and the second external terminal of the bulbous envelope; and means connecting the second AC terminal to the first external terminal of the bulbous envelope, the series combination of the inductive and capacitive means providing a lead circuit.

Accordingly, the present invention provides an improved implementation of a portion of the circuit disclosed in the aforementioned copending application Ser. No. 216,876, with the attendant improvements and advantages thereof. More specifically, whereas the aforementioned copending application disclosed the starter as a separate discrete component along with the lamp, inductive reactor and capacitor, the present invention simplifies the system by including the starter as an integral component of the lamp. This simplification reduces the cost of the starter element substantially by removing any socket that may be required for the starter, the glow-bottle glassware, and any metal enclosure that may be required for the starter. In the present integral lamp structure, the gas fill and pressure thereof in the glass outer jacket, or bulbous envelope, facilitates the glow starter operation and control of starter pulse amplitude, in addition to maintaining a non-corrosive atmosphere about the arc tube and its supporting and lead wire components. The glass outer jacket in addition to maintaining the proper glow starter atmosphere about the bimetals, continues to provide mechanical protection for the arc tube and minimize or eliminate any UV radiation emitted via the quartz glass arc tube. It was expected that this simplified and reduced cost lamp structure, would result in a significant loss of efficiency due to heat losses resulting from substitution of the inert gas at the desired pressure thereof in lieu of the customary vacuum maintained in the outer jacket. Quite surprisingly, however, we observed minimal, if any, loss in efficiency.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
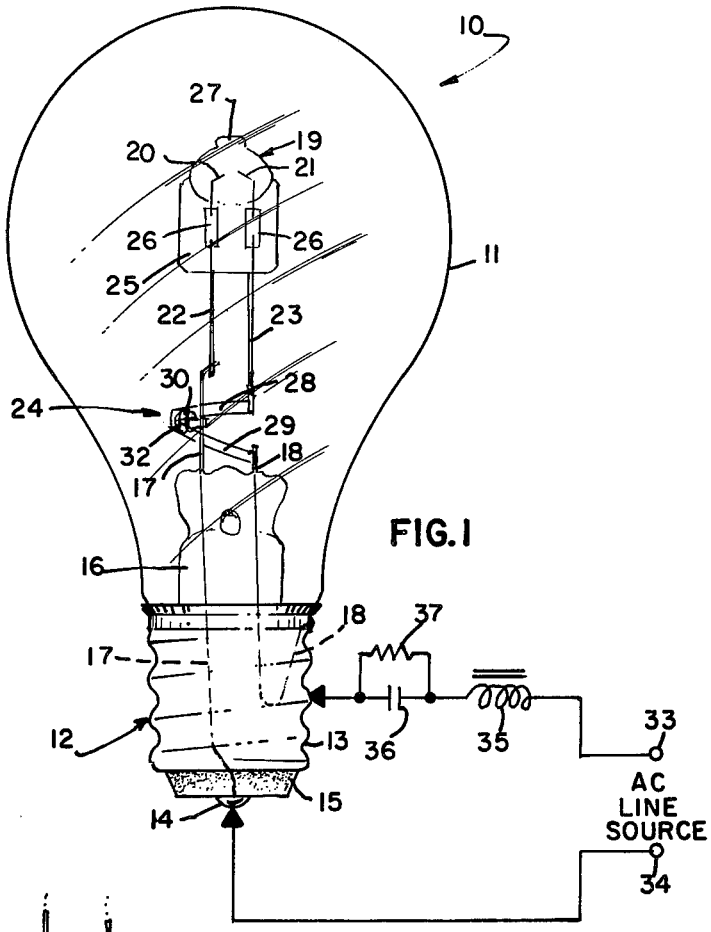
FIG. 1 is an elevational view of a low wattage high intensity discharge lamp having an integral starter in accordance with the invention, and also illustrating an interconnected circuit diagram of a lead circuit ballast useful for operation of the lamp.

Referring to FIG. 1 of the drawing, the lamp 10 includes an outer bulbous envelope 11 having a conventional screw-in base 12 including two external terminals, namely, screwshell 13 and center contact 14, separated from the screwshell by an insulating material 15. The outer jacket envelope 11 is preferably formed of a hard glass, such as a Nonex type (Corning Glass Works), preferably of a composition which minimizes transmission of UV radiation. Extending inwardly from the base and inside the envelope 11 is a reentrant glass stem mount 16 having a pair of rigid conductor support wires 17 and 18 sealed therethrough. The reentrant stem 16 is preferably formed of a hard glass 16 and sealed at the one end of the outer bulbous envelope to provide an hermetically sealed envelope 11. After passing through the stem 16, the conductor 17, or preferably a smaller gage lead-in wire attached thereto, is electrically connected to the center contact terminal 14, and the conductor 18, or a smaller gage lead-in wire attached thereto, is electrically connected to the outer shell terminal 13.

Disposed within the glass outer envelope 11 is an arc tube 19 enclosing a pair of spaced apart electrodes 20 and 21 which are electrically connected, respectively, to a pair of lead-in wires 22 and 23. The arc tube lead-in wire 22 is welded at its external end to the projecting end of the conductor support lead-in wire 17, and the arc tube lead-in wire 23 is electrically connected to an integral starter 24, as shall be described hereinafter. It will be noted that the external end of lead-in wire 23 is spaced apart from the projecting end of the conductor support wire 18.

In the specific implementation illustrated and a most useful embodiment of the invention, the arc tube 19 is a low wattage high intensity discharge device, such as the type described in the aforementioned copending applications Ser. Nos. 132,933 and 132,934. More specifically, the illustrated arc tube is single ended and formed of fused quartz tubing, referred to as quartz glass, having a press seal 25 at one end. The electrodes 20 and 21 enclosed within the hermetically sealed interior of the arc tube are bent toward one another to provide a predetermined spacing therebetween and are connected to molybdenum ribbons 26, which are embedded within the press seal 25. The ribbons 26 are then connected to the external lead-in wires 22 and 23. An exhaust tip-off 27 is located on the arc tube opposite the press seal. The arc tube is filled with an inert gas at a predetermined pressure, along with quantities of mercury and one or more selected iodides and metals.

Figure 2:
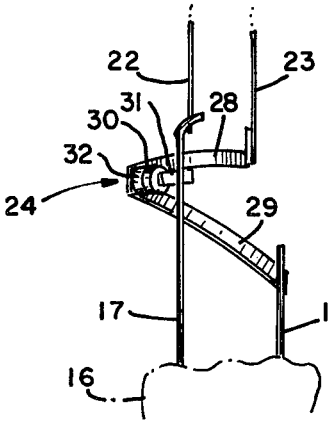
FIG. 2 is an enlarged fragmentary elevation showing the starter portion of the lamp of FIG. 1.

Referring now also to FIG. 2, the glow starter 24 comprises two bimetals 28 and 29, and a fixed contact 30. Bimetal 28 is mechanically and electrically connected at one end to the arc tube lead-in wire 23; bimetal 29 is electrically and mechanically connected at one end to the conductor support wire 18; and the fixed contact 30 may comprise a metallic button welded to a conductive segment 31, which in turn is welded, and thus electrically and mechanically connected, to the conductor support wire 17. The two bimetals 28 and 29 may comprise flexible strips, as illustrated, and are electrically connected together at one end and attached to a contact button 32, such as by welding. In order to provide the appropriate atmosphere for the flow starter, the interior of the hermetically sealed outer jacket envelope 11 is filled with an inert gas at subatmospheric pressure.

Figure 3:
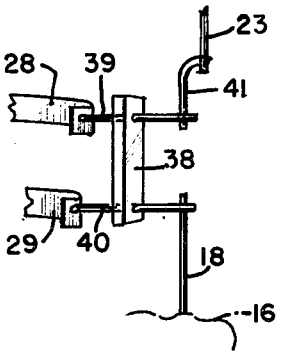
FIG. 3 is an enlarged fragmentary elevation showing an alternative embodiment of the starter of FIG. 2.

FIG. 3 illustrates an alternative embodiment with respect to the construction shown in FIG. 2 in the event greater mechanical rigidity is desired in the supporting structure for the arc tube 19. More specifically, lead-in wire 23 and conductor wire 18 are spaced apart by a rigid insulator, such as a glass bridge 38. In the specific implementation illustrated, a pair of rigid conductors 39 and 40 are sealed through the glass bridge 38. One end of conductor 39 is welded to an end of bimetal 28, while the other end of conductor 39 is welded to a rigid conductor segment 41, which in turn is welded to lead-in wire 23. Conductor 40 is welded at one end to bimetal 29 and at the other end to conductor support wire 18.

In the quiescent state of the starter, the bimetals 28 and 29 resiliently urge button 32 to make a normally closed contact with the fixed button 30. Hence, at normal room temperature and in the absence of current flowing through either of the bimetals, the starter 24 provides a normally closed switch across both the arc tube 19 and the external terminals 13 and 14.

The described lamp 10 including the integral glow starter 24 according to the invention, is particularly intended for use with a lead circuit ballast, such as illustrated by the circuit diagram in FIG. 1. The input terminals 33 and 34 of the ballast circuit are connected to an AC line source, e.g., 120 volts, 60 Hertz. An inductive reactor 35, such as a choke coil, and a capacitor 36 are series connected in that order between the AC input terminal 33 and external terminal 13 (screwshell) of the lamp 10. A discharge resistor 37 is connected across capacitor 36. AC input terminal 34 is connected to the center contact terminal 14 of the lamp 10.

The capacitive resistance of capacitor 36 is selected to be approximately twice the inductive reactance of inductor 35. Preferably, the capacitance of capacitor 36 should be approximately 10.5 microfarads or higher. In operation, upon initial energization of the illustrated circuit with AC input powder, ballast short circuit current is drawn through conductive wire 18, bimetal 29, fixed contact 30, and conductor wire 17. The resulting $I^2R$ in the bimetal 29 is sufficient to cause the necessary heat to flex both of the bimetals 29 and 28 so as to separate and open the contacts 32 and 30. When this open circuit occurs at the starter 24, the current drawn from the lamp ballast rapidly decreases and the inductive output of the ballast generates a high voltage pulse, thereby producing a switching transient across the electrodes 20 and 21 of arc tube 19 which provides sufficient energy to initiate a discharge therein. If for some reason the arc tube 19 does not start when the contacts 32 and 30 open, no current is drawn through the bimetals 28 and 29 whereupon the bimetals cool and relax until the contacts 32 and 30 reclose the starter switch. Heating of bimetal 29 again occurs causing the bimetals to flex and again open the starter contacts, whereupon another high votage starting pulse is generated. This starting process is repeated until a discharge is initiated in the arc tube 19. When the arc tube is ignited, current is drawn through both of the bimetals 28 and 29, the $I^2R$ of which is sufficient to maintain the bimetals separated from the fixed contact 30 and thereby keep the contacts 30 and 32 open.

It is clear that the glow starter 24 is a current responsive device as opposed to the conventional voltage type glow starters. Operation of the starter 24 is not a function of the open circuit voltage, rather the $I^2R$ deflecting function is responsive to short circuit current. The starter functions in circuits having low open circuit voltages where more common glow bottle starter techniques have not been able to be utilized.

The amplitude of the high voltage pulse generated by the starter switch is given by L di/dt where L is the output inductance of the reactor 35, di is the change in current when the starter contacts are open, and dt is the time required for di to occur. Thus, the amplitude of the pulse can be controlled either by controlling the current through the closed starter contacts or by controlling the speed at which the starter contacts open. It has been found that the amplitude of the starter pulse can be further controlled via the glow starter 24 by selection of the gas and pressure filling the outer bulbous envelope 11. Further, as this high voltage pulse is generated when the starter contacts open, it is clear that the pulse occurs at a random time during the AC cycle of the lamp or voltage.

In regard to the aforementioned transient high voltage switching pulse across the arc tube, we have made some interesting observations. If the lamp 10 includes a low wattage high intensity discharge arc tube and the circuit illustrated in FIG. 1 is employed with only a reactor, i.e., without a capacitor 36, generation of a high voltage pulse will not reliably ignite the arc tube 19 even though the pulse amplitude (L di/dt) is identical to that of a FIG. 1 circuit including a capacitor. More specifically, we have found that this is dure to the fact that making the transition within the lamp from the flow to the arc state is quite critical in the low wattage type arc tube. More specifically, we have found that in the case of a reactor ballast without a series capacitor, ignition of the arc tube may take place but the transition becomes extremely unreliable. Hence, the capacitor 36 is quite necessary for the glow-to-arc transition to take place. The capacitor, together with the starter and reactor, appears to provide a voltage increasing effect in the circuit.

More specifically, when the bimetals 28 and 29 of the starter 24 provide a closed circuit via fixed contact 30, and the capacitive reactance of capacitor 36 is approximately twice the inductive reactance of reactor 35, there is somewhat of a rise in the voltage across the capacitor. The voltage across the capacitor 36 is changing at 60 times per second with a somewhat flattened sinusoidal waveform. At this specific point in time that the starter contacts are open, there is a voltage across the capacitor 36. For example, say that the starter contacts are open at zero current, such that di/dt equals zero. There is a finite voltage across the capacitor, across the open starter contacts, and across the arc tube. We have a capacitor voltage with the AC line voltage superimposed thereacross. Accordingly, there is a voltage increasing effect of the AC line over the capacitor DC voltage. Hence, with the opening of the starter contacts plus the high voltage across the capacitor, we effectively provide a voltage increasing circuit which makes possible a transition from the glow-to-arc state.

In a specific implementation, the outer bulbous envelope 11 was formed of Corning type 7720 hard glass, and the reentrant stem 16 was made of the same type hard glass. This provides a relatively strong outer jacket for protecting the interior components of the lamp. The conductor support wires 17 and 18 were nickel. In the arc tube 19, the envelope thereof was formed of fused quartz tubing; the electrodes were thoriated tungsten; ribbons 26 were molybdenum; and the external lead-in wires 22 and 23 wire 30 mil. diameter molybdenum. The projecting end of nickel wire 17 was welded to the depending end of molybdenum wire 22. The bimetals 28 and 29 comprised strips of Chase 6650 material having a thickness of 0.004 inch, a width of 0.040 inch and a length of ⅝ inch. The contact buttons 30 and 32 comprised silver-plated copper, and the fixed contact 30 was welded to a short segment of nickel wire which in turn was welded to the nickel support wire 17. Button 32 was welded to the ends of bimetal strips 28 and 29 which were also welded together. The other end of bimetal strip 28 was welded to the depending end of the lead-in wire 23, and the other end of bimetal strip 29 was welded to the projecting end of the nickel wire 18. The tension of the bimetal strips forcing contact 32 against contact 30 was about 4 grams. The outer bulbous envelope 11 was filled with an atmosphere of argon gas at a pressure of about 4 torr., thereby facilitating glow starter operation and controlling starter pulse amplitude, as described hereinbefore, as well as maintaining a non-corrosive atmosphere within the outer jacket. The starter 24 was designed to handle about 0.8 ampere. The electrical characteristics of the low wattage, metal halide high intensity discharge lamp (arc tube 19) were approximately 50 volts, 1 ampere, 40 watts.

Although the invention has been described with respect to a specific embodiment it will be appreciated that modifications and changes may be made by those skilled in the art without departing from the true spirit and scope of the invention. For example, in the case of the specifically illustrating integral starter, the two bimetals may be formed from a single strip which is separated longitudinally for a substantial portion of its length; accordingly, the connection at one end would be the unseparated portion of the strip. Further, the circuit may employ a normally closed current-responsive glow starter means other than the specific type illustrated; e.g., a single bimetal with a proximate heating means. A copending application Ser. No. 139,310, filed Apr. 11, 1980 and assigned to GTE Laboratories Incorporated, describes a thermal switch including a single bimetal and associated heater resistor which can be included within the outer jacket of an arc discharge lamp; however, in contrast to the integral starter of the present invention, the thermal switch of the copending application is not a glow starter means wherein the fill gas and pressure thereof within the outer jacket facilitate operation of the starter and permit control of the starter pulse amplitude. Further yet, in some lamp applications, it is contemplated that even a normally-open voltage responsive switching means may be employed as the integral glow starter.

We claim:

1. An arc discharge lamp comprising:

an hermetically sealed bulbous glass envelope having first and second external terminals;

an hermetically sealed arc tube disposed within said bulbous envelope, said arc tube enclosing a pair of spaced apart electrodes;

first substantially rigid conductor means within said bulbous envelope for electrically connecting one of said arc tube electrodes to said first external terminal;

second conductor means within said bulbous envelope electrically connected to the other of said arc tube electrodes;

third conductor means within said bulbous envelope spaced apart from said second conductor means and electrically connected to said second external terminal;

a glow starter means within said bulbous envelope comprising a first bimetal connected at one end to said second conductor means, a second bimetal connected at one end to said third conductor means, and a fixed first contact means disposed on said first conductor means, said bimetals being electrically connected together at the other end which makes a normally closed contact with said fixed contact in the quiescent state of said starter means; and an inert gas within said bulbous envelope at subatmospheric pressure.

2. The lamp of claim 1 wherein: the first and second external terminals of said bulbous envelope are connectable to a source of lamp operating current; upon initial energization of said first and second external terminals, short circuit current through said first and third conductor means connected to said starter means is operative to flex said second bimetal for separating said bimetals from said fixed contact means to provide an open circuit thereat and produce a high voltage pulse switching transient across said arc tube electrodes; upon starting of a discharge in said arc tube, the lamp current flow through said second and third conductor means is operative to maintain said bimetals separated from said rigid member.

3. The lamp of claim 2 wherein said lamp is intended for connection to a circuit comprising: first and second input terminals for connection to a source of AC line voltage; an inductive means and a capacitive means series connected in that order between said first AC input terminal and said second external terminal of the bulbous envelope; and means connecting said second AC terminal to the first external terminal of said bulbous envelope; said series combination of the inductive and capacitive means providing a lead circuit.

4. The lamp of claim 2 wherein said arc tube is a low wattage high intensity discharge device.

5. The lamp of claim 2 wherein the gas fill of said bulbous envelope is argon at a pressure of about 4 torr.

6. The lamp of claim 2 wherein each of said bimetals is in the form of a flexible strip, and said strips are connected together at one end which is welded to a second contact means, said second contact means being resiliently urged against said fixed first contact means by said bimetals in the quiescent state of said starter means.

7. The lamp of claim 1 wherein a screw-in base is attached to said bulbous envelope, said base having a screw shell as said second external terminal and a center contact as said first external terminal.

8. The lamp of claim 1 wherein said arc tube is formed of quartz glass.

9. The lamp of claim 8 wherein said bulbous envelope is formed of a hard glass.

10. The lamp of claim 1 wherein said third conductor means is spaced apart from said second conductor means by a rigid insulator interconnected therebetween for rigidizing support of said arc tube within said bulbous envelope.

11. The lamp of claim 1 wherein said arc tube has a pair of lead-in wires respectively connected to said pair of electrodes, said bulbous envelope has a reentrant glass stem sealed at one end thereof, said first conductor means comprises one of said lead-in wires of the arc tube together with a first rigid support wire connected thereto at one end and sealed through said reentrant stem, said second conductor means comprises the other of said lead-in wires of the arc tube, and said third conductor means comprises a second rigid support wire sealed through said reentrant stem.

* * * * *